United States Patent [19]

Fukuroi

[11] 4,380,098

[45] Apr. 19, 1983

[54] SLIDE FASTENER STRINGER

[75] Inventor: Takeo Fukuroi, Uozu, Japan

[73] Assignee: Yoshida Kogyo K. K., Tokyo, Japan

[21] Appl. No.: 215,059

[22] Filed: Dec. 10, 1980

[30] Foreign Application Priority Data

Dec. 26, 1979 [JP] Japan ..... 54-185262[U]

[51] Int. Cl.[3] ..... A44B 19/04

[52] U.S. Cl. ..... 24/205.16 R; 24/205.13 R

[58] Field of Search ..... 24/205.1 R, 205.13 R, 24/205.16 R, 205.11 F

[56] References Cited

U.S. PATENT DOCUMENTS

| | | | |
|---|---|---|---|
| 2,056,856 | 10/1936 | Hora | 24/205.16 R |
| 2,075,763 | 3/1937 | Kelley | 24/205.16 R |
| 2,735,139 | 2/1956 | Morin | 264/252 |
| 2,853,758 | 9/1958 | Topf | 24/205.1 R |
| 2,910,754 | 11/1959 | Morin | 24/205.1 R |
| 3,885,275 | 5/1975 | Hasegawa | 24/205.16 R |
| 3,928,698 | 12/1975 | Yamaguchi et al. | 24/205.16 R |
| 4,210,985 | 7/1980 | Scott | 24/205.16 R |
| 4,231,138 | 11/1980 | Moertel | 24/205.16 R |
| 4,276,679 | 7/1981 | Moertel | 24/205.13 R |
| 4,290,176 | 9/1981 | Wulz | 24/205.16 R |
| 4,297,770 | 11/1981 | Wulz | 24/205.13 R |

*Primary Examiner*—Paul J. Hirsch

*Attorney, Agent, or Firm*—Hill, Van Santen, Steadman, Chiara & Simpson

[57] ABSTRACT

A slide fastener stringer comprising a pair of tapes made essentially of thermoplastic fibers and each tape having a bead extending longitudinally therealong, a series of discrete coupling scoops made of a synthetic resin, each of said scoops having a coupling head, an upper leg and a lower leg, the tape having a longitudinal edge portion including the bead and defining a region mounting the scoops and an opening formed therein and extending closely along the marginal edges of the scoop legs, and a connecting strip formed integrally with the legs and accommodated in the opening and interconnecting the upper and lower legs, the bead having a width in the range of from one-third to two-fifths of the transverse length of the scoop legs.

2 Claims, 4 Drawing Figures

SLIDE FASTENER STRINGER

BACKGROUND OF THE INVENTION

1. Field of the Invention

This invention relates to sliding clasp fasteners and more particularly improvements in a slide fastener stringer having a discrete formation of coupling elements or scoops mounted on a support tape. A series of such scoops are formed on the tape by injection or extrusion molding of a plastic material.

2. Prior Art

It has heretofore been proposed to use synthetic resins as the material for forming fastener coupling elements for reasons of fashionability and physical feel unavailable from metallic materials. Certain types of plastic material such as for example polyacetal have also been preferred for their physical strength comparable to metals. However, polyacetal is rather weak in its resistance to shock, and fastener elements made thereof are prone to be brittle when applied to slide fasteners used on bags, outdoor canvas and other articles that are handled in a rough manner. Nylon has been proposed as a substitute for polyacetal as it is much stronger in shock-resistance. However, due to its softness, nylon fastener elements do not have a satisfactory anchoring strength at the fastener tape and would often tend to spread apart at their leg portions when the fastener tape was soaked wet and swollen. To eliminate this problem, means have been considered to interconnect the two oppositely disposed legs of the element by a suitable connecting strip provided in an opening in the tape, the opening being formed by punching, cutting or by a piercing pin. However, due to the limitation imposed on the size of such an opening and hence the size of the connecting strip, the fastener elements were liable to spread apart along their superposed legs or otherwise move out of place when the fastener tape was wetted and swollen, resulting in sluggish or otherwise inoperative manipulation of the slider. This tendency is pronounced when the bead on the edge of the tape is increased in size to strengthen resistance to lateral pull.

SUMMARY OF THE INVENTION

It is therefore an object of the present invention to provide a slide fastener or zipper which will eliminate or alleviate the foregoing difficulties of the prior art.

It is a more specific object of the invention to provide a slide fastener stringer having a discrete coupling element structure made of nylon, polypropylene or other synthetic resins of relatively high shock-resistance, the fastener element being anchored to the fastener tape with increased strength and stability to ensure the maintenance of its correct position and posture relative to the tape under all conceivable rough conditions of use.

According to the invention, there is provided a slide fastener stringer comprising a pair of tapes made essentially of thermoplastic fibers and each tape having a bead extending longitudinally therealong, a series of discrete coupling scoops made of a synthetic resin, each of said scoops having a coupling head, and upper leg and a lower leg, said tape having a longitudinal edge portion including said bead and defining a region mounting said scoops and an opening formed therein and extending closely along the marginal edges of said scoop legs, and a connecting strip accommodated in said opening and interconnecting said upper and lower legs, said bead having a width in the range of from one-third to two-fifths of the transverse length of said scoop legs.

The objects and advantages of the invention will be better understood from the following description taken in connection with a preferred embodiment thereof shown in the accompanying drawings.

DETAILED DESCRIPTION OF A PREFERRED EMBODIMENT

Figure 1:
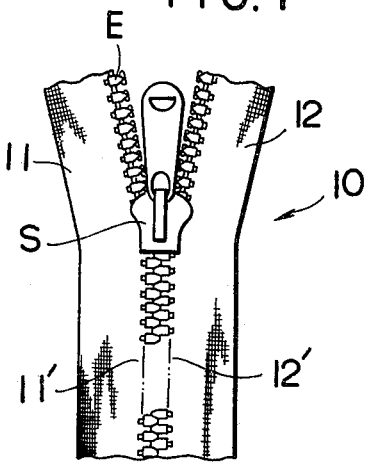
FIG. 1 is a plan view of a portion of a slide fastener provided in accordance with the invention.

As shown in FIG. 1, a slide fastener 10 comprises a pair of stringer tapes 11,12 each having mounted thereon a series of discrete fastener coupling elements or scoops E. The stringer tapes 11,12 are engaged and disengaged by a slider S as the latter is moved reciprocally to take the two opposed series of scoops E into and out of engagement in a well known manner.

The tape 11,(12) is fabricated from thermoplastic resin fibers such as of polyester or a blend of such plastic fibers and naturally occurring fibers. It has a longitudinal edge portion 11',(12') including a bead 13 (FIG. 2) and defining a region for mounting the scoops E. The scoops E shown for purposes of illustration to be made from nylon (FIG. 4) are each provided with an upper leg portion Ea and a lower leg portion Eb which are mounted on the tape 11,(12) astride the opposite surfaces of the longitudinal edge portion 11',(12') and (FIG. 2) and with a coupling head portion Ec integral with the leg portions and protruding from the bead 13 for coupling engagement with the corresponding head portion Ec on the opposite mating tape. At an end of the scoop E opposite to or remote from the coupling head portion Ec, there is provided a tail portion Ed of reduced width and thickness extending longitudinally from the upper and lower leg portions for guided sliding engagement with the slider S. While the tail portion Ed can be dispensed with, its presence is advantageous in that an opening later described can be made so much larger.

Figure 2:
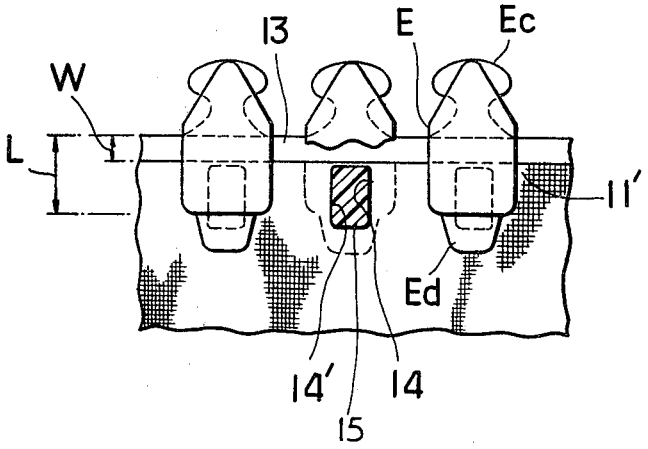
FIG. 2 is an enlarged view of a portion of FIG. 1, partially broken away.
Figure 3:
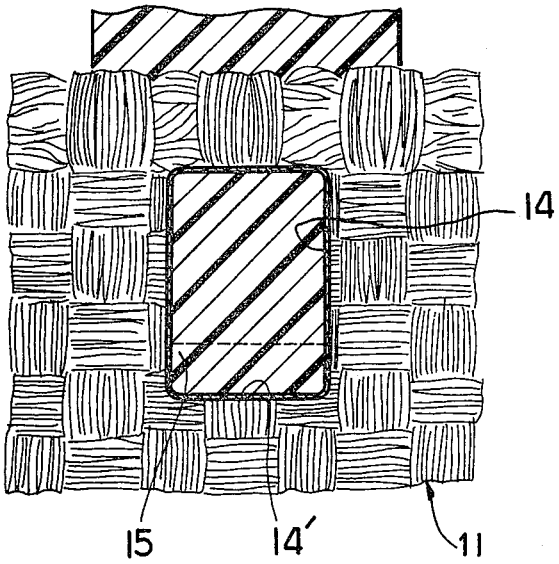
FIG. 3 is a schematic fragmentary cross-sectional view on a further enlarged scale of a portion of the stringer.
Figure 4:
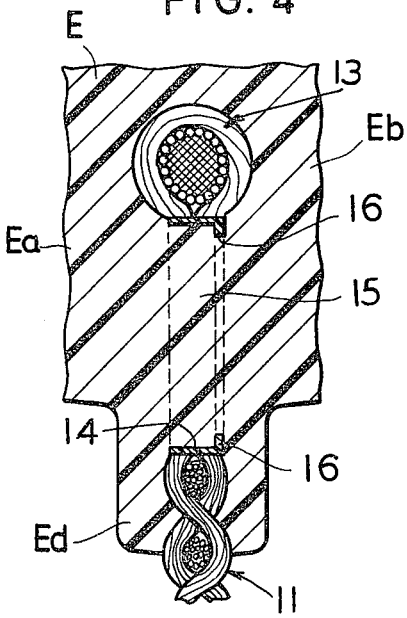
FIG. 4 is an enlarged cross-sectional fragmentary side view of the stringer and scoop.

As shown in FIGS. 2 and 3, the tape 11,(12) has an opening 14 closely adjacent to the bead 13 for accommodating therein a connecting strip 15 which interconnects the upper and lower leg portions Ea, Eb by thermal fusion when the scoops E are anchored to the tape 11,(12) by means injection or extrusion molding in a manner known in the art. The opening 14 may be formed by supersonic processing effected by for example a rotary toothed anvil cooperating with a supersonic horn, in which instance the opening 14 is defined by a reinforced marginal edge 14' as the polyester fibers constituting the tape are fused rigidly together. Designated at 16 in FIG. 4 is a flange-like lug resulting from fusion of the tape fibers in contact with the toothed anvil.

The opening 14 is generally dimensioned in complementary relation to the leg portions Ea, Eb of the scoops E and the larger the better for increasing the anchoring strength of the scoops E with respect to the tape 11,(12).

According to an important aspect of the invention, the width W of the bead 13 or the diameter thereof measured transversely of the tape 11,(12) is selected to be in the range of from one-third to two-fifths of the transverse length L of the leg portion Ea, (Eb) of the scoop E. This arrangement makes it possible to minimize the total thickness of the scoop E on one hand and to maximize the area for the opening 14 on the other hand.

The dimensional relation between the bead 13 and the scoop legs Ea, (Eb) as specified herein contributes to reduce to an absolute minimum the extent to which the bead 13 expands when the fastener tape is wetted and swollen, and further to reduce the extent to which the tape is stretched under the influence of external forces to maintain the scoops E securely positioned on the tape against lateral pull. A smaller width W of the bead 13 than ⅓ of the length L of the scoop legs Ea, (Eb) will fail to achieve the above advantages and will result in a disturbed scoop-to-scoop pitch and malfunctioning of the fastener. A greater width W of the bead 13 than 2/5 of the leg length L will necessitate an undue increase in the height of the scoop E and reduce the area of the opening 14 that may be provided.

Since the opening 14 according to the invention is sufficiently large, the opening extending closely along the marginal edges of the scoop legs Ea, (Eb), it is literally possible to provide a correspondingly large connecting strip 15 that is fitted into and secured in the opening 14 to join the upper and lower scoop legs Ea, (Eb) firmly together.

As the opening 14 is formed by supersonic processing, its marginal edge 14' is rigidified upon fusion of the individual tape fibers. This fusion will add strength to the integrated stringer structure including the scoops E and the tape edge 11',(12'), and will also serve to facilitate the positioning of the scoops E at the time of molding.

Although various minor modifications may be suggested by those versed in the art, it should be understood that I wish to embody within the scope of the patent warranted thereon, all such embodiments as reasonably and properly come within the scope of my contribution to the art.

What is claimed is:

1. A slide fastener stringer comprising:

(a) a tape made essentially of thermoplastic fibers having a longitudinal edge portion including a bead extending longitudinally therealong, there being a series of openings formed in and along said longitudinal edge portion, each of said openings being located closely adjacent to said bead and each opening being defined by a rigid marginal edge constituted by fused tape fibers;

(b) a series of discrete coupling scoops made of a synthetic resin and mounted on and along said longitudinal edge portion, each in registration with only one of said openings, each of said scoops having a coupling head, an upper leg and a lower leg, said upper and lower legs being disposed astride the opposite surfaces of said longitudinal edge portion, each said opening extending closely along and between marginal edges of each pair of scoop legs;

(c) said bead having a width in the range of one-third to two-fifths of the length of said scoop legs; and (d) a series of separate connecting strips individually accommodated in one of said openings and respectively interconnecting said upper and lower legs.

2. A slide fastener stringer according to claim 1, each said scoop having a pair of tail portions of reduced width and thickness extending lengthwise from said upper and lower legs remotely from said coupling head, each said opening being covered partly by said upper and lower legs of a respective one of said scoops and partly by said tail portions of said respective one scoop.

* * * * *